US008572869B2

(12) United States Patent
Mayden et al.

(10) Patent No.: US 8,572,869 B2
(45) Date of Patent: Nov. 5, 2013

(54) ARTICLE OF FOOTWEAR WITH HEEL CUSHIONING SYSTEM

(75) Inventors: Jason C. Mayden, Beaverton, OR (US); Craig A. Nomi, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/440,436

(22) Filed: Apr. 5, 2012

(65) Prior Publication Data

US 2012/0186100 A1 Jul. 26, 2012

Related U.S. Application Data

(62) Division of application No. 12/367,300, filed on Feb. 6, 2009, now Pat. No. 8,181,364.

(51) Int. Cl.
*A43B 13/16* (2006.01)
*A43B 13/18* (2006.01)

(52) U.S. Cl.
USPC ..... 36/103; 36/25 R; 36/28; 36/35 R

(58) Field of Classification Search
USPC ..... 36/103, 25 R, 28, 35 R, 102, 30 R, 31, 36/27, 104
See application file for complete search history.

(56) References Cited

U.S. PATENT DOCUMENTS

| | | | | |
|---|---|---|---|---|
| 4,342,158 | A | | 8/1982 | McMahon et al. |
| 4,494,321 | A | | 1/1985 | Lawlor |
| 4,638,575 | A | | 1/1987 | Illustrato |
| 4,918,838 | A | | 4/1990 | Chang |
| 5,086,574 | A | | 2/1992 | Bacchiocchi |
| 5,185,943 | A | * | 2/1993 | Tong et al. ..... 36/28 |
| 5,560,126 | A | | 10/1996 | Meschan et al. |
| 5,615,497 | A | | 4/1997 | Meschan |
| 5,625,963 | A | | 5/1997 | Miller et al. |
| 5,628,128 | A | | 5/1997 | Miller et al. |
| 5,642,575 | A | | 7/1997 | Norton et al. |
| 5,653,046 | A | | 8/1997 | Lawlor |
| 5,675,914 | A | | 10/1997 | Cintron |
| 5,678,327 | A | | 10/1997 | Halberstadt |
| 5,797,199 | A | | 8/1998 | Miller et al. |
| 5,806,210 | A | | 9/1998 | Meschan |
| 5,826,352 | A | | 10/1998 | Meschan et al. |
| 5,901,467 | A | | 5/1999 | Peterson et al. |
| 5,918,384 | A | | 7/1999 | Meschan |
| 5,970,628 | A | | 10/1999 | Meschan |
| 6,050,002 | A | | 4/2000 | Meschan |

(Continued)

FOREIGN PATENT DOCUMENTS

| | | |
|---|---|---|
| EP | 0352807 | 1/1990 |
| EP | 1839511 | 10/2007 |
| EP | 1844673 | 10/2007 |

OTHER PUBLICATIONS

International Search Report and Written Opinion, mailed Jul. 24, 2010, from PCT Application No. PCT/US2010/023004.

(Continued)

*Primary Examiner* — Ted Kavanaugh
(74) *Attorney, Agent, or Firm* — Plumsea Law Group, LLC

(57) ABSTRACT

An article of footwear with a heel cushioning system is disclosed. The heel cushioning system includes a sole, a curved plate and tread members. The tread members may lift a heel portion of a sole above a ground surface. The curved plate may deflect when a force is applied to the sole.

20 Claims, 13 Drawing Sheets

(56) References Cited

U.S. PATENT DOCUMENTS

| | | | |
|---|---|---|---|
| 6,195,916 | B1 | 3/2001 | Meschan |
| 6,226,900 | B1 | 5/2001 | Mazars |
| 6,233,846 | B1 | 5/2001 | Sordi |
| 6,324,772 | B1 | 12/2001 | Meschan |
| 6,467,197 | B1 | 10/2002 | Mitsui et al. |
| 6,604,300 | B2 | 8/2003 | Meschan |
| 6,647,646 | B2 | 11/2003 | Mitsui et al. |
| 6,662,471 | B2 | 12/2003 | Meschan |
| 6,763,615 | B2 | 7/2004 | Mitsui et al. |
| 6,962,009 | B2 | 11/2005 | Meschan |
| 6,966,129 | B2 | 11/2005 | Meschan |
| 6,966,130 | B2 | 11/2005 | Meschan |
| 6,968,635 | B2 | 11/2005 | Meschan |
| 6,996,923 | B2 | 2/2006 | Meschan |
| 6,996,924 | B2 | 2/2006 | Meschan |
| 7,040,040 | B2 | 5/2006 | Meschan |
| 7,040,041 | B2 | 5/2006 | Meschan |
| 7,043,857 | B2 | 5/2006 | Meschan |
| 7,069,671 | B2 | 7/2006 | Meschan |
| 7,076,892 | B2 | 7/2006 | Meschan |
| 7,080,467 | B2 | 7/2006 | Marvin et al. |
| 7,082,700 | B2 | 8/2006 | Meschan |
| 7,086,179 | B2 | 8/2006 | Dojan et al. |
| 7,086,180 | B2 | 8/2006 | Dojan et al. |
| 7,089,689 | B2 | 8/2006 | Meschan |
| 7,100,310 | B2 | 9/2006 | Foxen et al. |
| 7,114,269 | B2 | 10/2006 | Meschan |
| 7,127,835 | B2 | 10/2006 | Meschan |
| 7,155,843 | B2 | 1/2007 | Meschan |
| 7,331,124 | B2 | 2/2008 | Meschan |
| 7,334,349 | B2 | 2/2008 | Sokolowski et al. |
| 7,380,350 | B2 | 6/2008 | Meschan et al. |
| 7,401,420 | B2 | 7/2008 | Dojan et al. |
| 8,181,364 | B2 * | 5/2012 | Mayden et al. ..... 36/103 |
| 2006/0137221 | A1 | 6/2006 | Dojan et al. |
| 2006/0201029 | A1 | 9/2006 | Dojan et al. |
| 2006/0213082 | A1 | 9/2006 | Meschan |
| 2006/0254086 | A1 | 11/2006 | Meschan et al. |
| 2006/0277793 | A1 | 12/2006 | Hardy et al. |
| 2007/0033832 | A1 | 2/2007 | Marvin et al. |
| 2007/0101614 | A1 | 5/2007 | Meschan |
| 2007/0119073 | A1 | 5/2007 | Brewer et al. |
| 2007/0119076 | A1 | 5/2007 | Brewer et al. |
| 2007/0193065 | A1 | 8/2007 | Nishiwaki et al. |
| 2007/0240331 | A1 | 10/2007 | Borel |
| 2008/0016719 | A1 | 1/2008 | Aveni et al. |
| 2008/0022553 | A1 | 1/2008 | McDonald et al. |
| 2008/0141563 | A1 | 6/2008 | Meschan |
| 2008/0201982 | A1 | 8/2008 | Aveni et al. |
| 2008/0201983 | A1 | 8/2008 | Dojan et al. |
| 2008/0201984 | A1 | 8/2008 | Dojan et al. |
| 2008/0201985 | A1 | 8/2008 | Dojan et al. |
| 2008/0222917 | A1 | 9/2008 | Dojan et al. |
| 2009/0113758 | A1 * | 5/2009 | Nishiwaki et al. ..... 36/88 |
| 2010/0199523 | A1 | 8/2010 | Mayden et al. |

OTHER PUBLICATIONS

International Preliminary Report on Patentability (inclusing Written Opinion of the ISA) mailed Aug. 18, 2011 in International Application No. PCT/US2010/023004.

* cited by examiner

ARTICLE OF FOOTWEAR WITH HEEL CUSHIONING SYSTEM

CROSS-REFERENCE TO RELATED APPLICATION

This application is a divisional of U.S. Pat. No. 8,181,364, currently U.S. application Ser. No. 12/367,300, entitled "Article Of Footwear With Heel Cushioning System", filed on Feb. 6, 2009, and issued on May 22, 2012, which application is hereby incorporated by reference in its entirety.

BACKGROUND

The present invention relates to an article of footwear, and in particular to a sports shoe with a heel cushioning system.

Articles with cushioning systems have been proposed. Miller et al. (U.S. Pat. No. 5,797,199) teaches a shoe with pods. The sole includes a plurality of concave cavities. Miller teaches an insert that is made of a thermoplastic material or graphite material and can be used to help restore the midsole after the application of a force.

Hardy et al. (U.S. patent application publication number 2006/0277793) teaches a shoe with a heel grid system. Hardy teaches a midsole insert including a grid system. The grid system comprises a grid of flexible fibers. Hardy also teaches a base structure that can be used to limit the deflection of the grid system. Hardy teaches that the base structure can have a curved shape.

The related art lacks provisions for supporting an irregularly shaped insert substantially open to the ground on a lower surface of an insole. There is a need in the art for a design that solves these problems.

SUMMARY

The invention discloses an article of footwear with a heel cushioning system. In one aspect, the invention provides an article of footwear, comprising: a sole including a forefoot portion, an arch portion and a heel portion; the heel portion including a lower concave surface; a curved plate configured for deflection when a force is applied to an upper surface of the sole; the curved plate including a central portion that confronts the lower concave surface of the sole and the curved plate including a peripheral portion disposed outward from the central portion; the curved plate further including at least one leg portion, the at least one leg portion extending from the central portion to the peripheral portion; and where the central portion is configured to deform under a predetermined force applied by a heel.

In another aspect, the invention provides an article of footwear, comprising: a sole including a forefoot portion, an arch portion and a heel portion a curved plate configured for deflection when a force is applied to an upper surface of the sole; the curved plate further including at least one leg portion, the at least one leg portion extending away from the central portion; a first tread member and a second tread member disposed on a peripheral sole portion of the sole, the first tread member and the second tread member being separated by a gap; and where an end portion of the at least one leg portion is disposed adjacent to the gap.

In another aspect, the invention provides an article of footwear, comprising: a sole including a forefoot portion, an arch portion and a heel portion; the sole including a longitudinal direction associated with a length of the sole; the sole including a lateral direction associated with a width of the sole, the lateral direction being generally perpendicular to the longitudinal direction; the sole including a vertical direction that is generally perpendicular to the longitudinal direction and the lateral direction; the curved plate including a central portion and at least one leg portion extending outwards from the central portion; the at least one leg portion including a first end portion disposed adjacent to a peripheral sole portion of the sole and a second end portion disposed adjacent to the central portion; and where the distance between the first end portion and the second end portion along the vertical direction is substantially reduced when a predetermined force is applied to the central portion of the curved plate.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
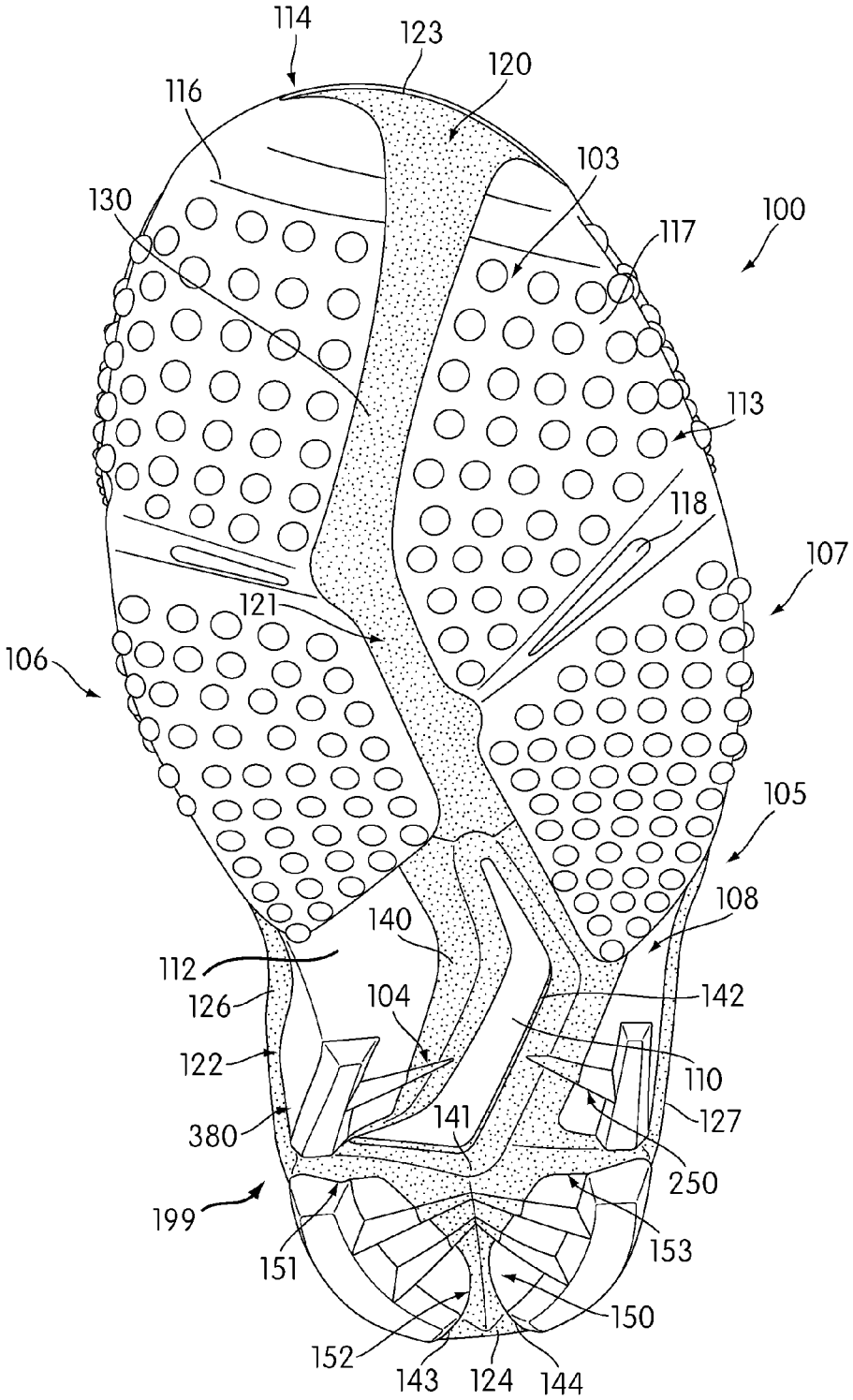
FIG. 1 is a bottom isometric view of an exemplary embodiment of a heel cushioning system associated with an article of footwear.
Figure 2:
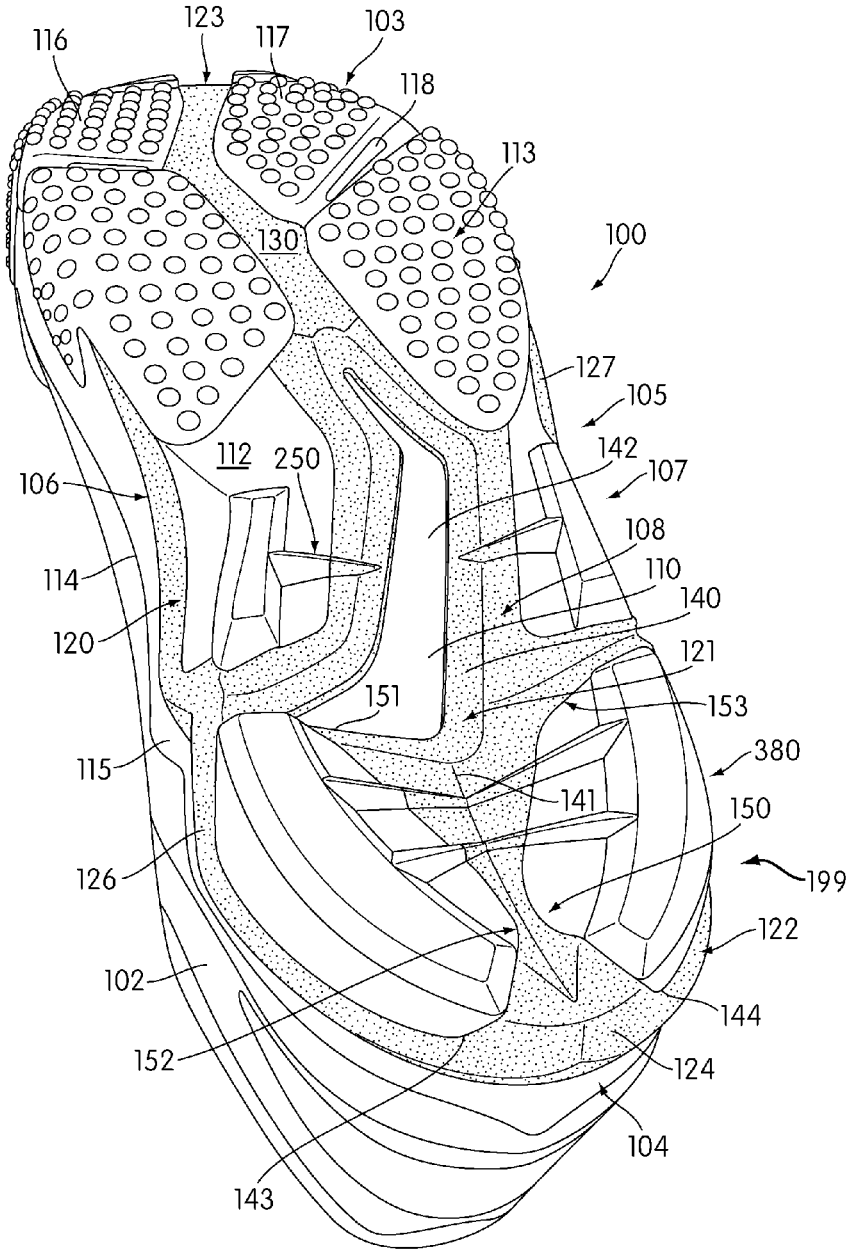
FIG. 2 is a bottom isometric view of an exemplary embodiment of a heel cushioning system associated with an article of footwear.
Figure 3:
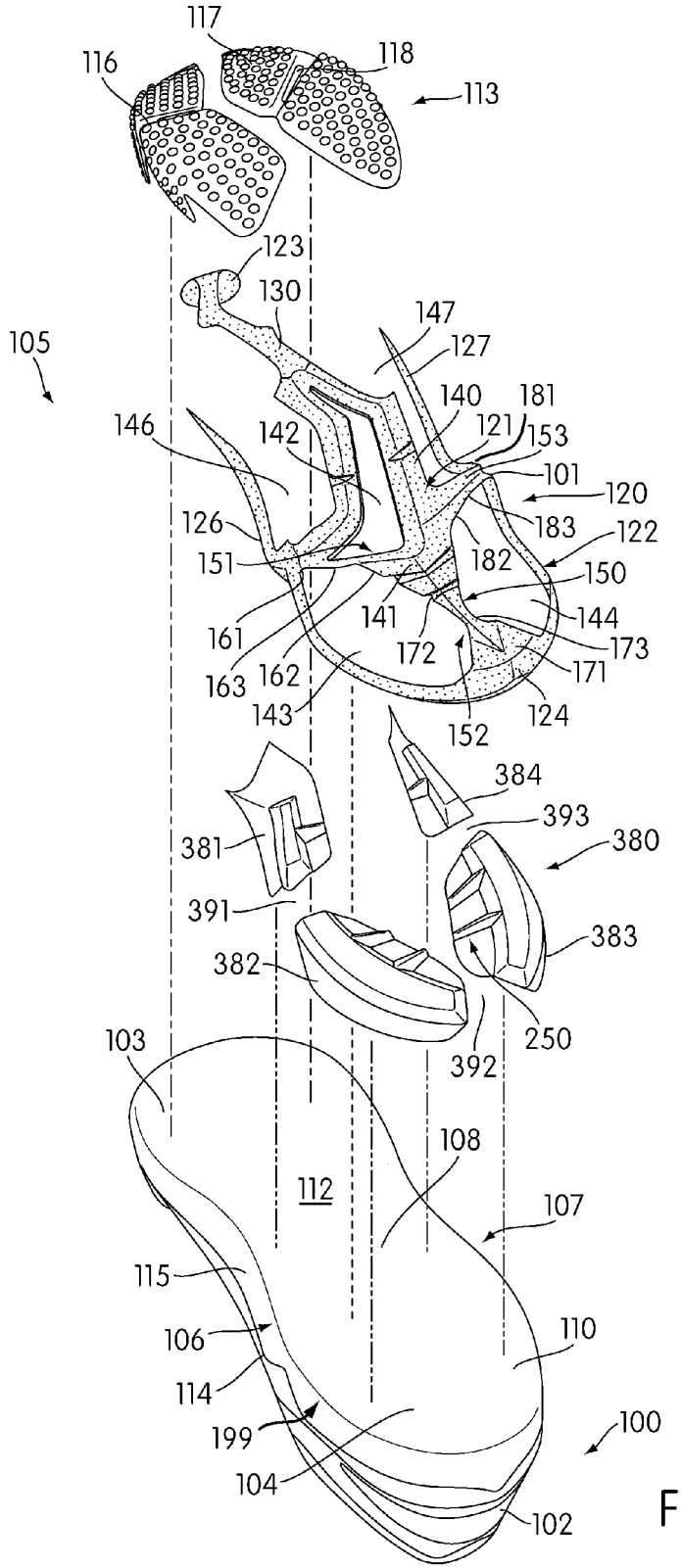
FIG. 3 is an exploded view of an exemplary embodiment of a heel cushioning system associated with an article of footwear.

FIGS. 1-3 illustrate an exemplary embodiment of article of footwear 100. In particular, FIGS. 1 and 2 are isometric views of an exemplary embodiment of article of footwear 100 and FIG. 3 is an exploded view of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, baseball shoes as well as other kinds of shoes. As shown in FIGS. 1-3, article of footwear 100, also referred to simply as article 100, is intended to be used with a left foot; however, it should be understood that the following discussion may equally apply to a mirror image of article of footwear 100 that is intended for use with a right foot.

Article of footwear 100 includes upper 102. Upper 102 is configured to receive a foot of a wearer of article 100. Generally, upper 102 may be any type of upper. In particular, upper 102 could have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Article of footwear 100 also includes sole 105. In different embodiments, sole 105 may include different components. For example, sole 105 may include an outsole, a midsole, and/or an insole. In one embodiment, sole 105 includes midsole 110 and outsole 113.

Sole 105 can also include forefoot portion 103. Forefoot portion 103 may be associated with a forefoot of a foot inserted within article 100. In addition, sole 105 includes heel portion 104 that may be associated with a heel of a foot inserted within article 100. In a similar manner, sole 105 includes arch portion 108. Arch portion 108 may be disposed between forefoot portion 103 and heel portion 104.

Sole 105 can also comprise medial portion 106. Medial portion 106 may be associated with an inside of a foot. Likewise, sole 105 can comprise lateral portion 107 disposed opposite of medial portion 106. Lateral portion 107 may be associated with an outside of a foot.

In addition, sole 105 includes lower surface 112. Generally, lower surface 112 may be configured to contact a ground surface. Examples of ground surfaces include, but are not limited to: natural turf, synthetic turf, dirt, as well as other surfaces. In some embodiments, lower surface 112 may comprise a substantially flat surface configured to contact a ground surface. In other embodiments, lower surface 112 may include protruding portions to engage a ground surface. In still other embodiments, lower surface 112 may comprise a concave surface with respect to a ground surface. In an exemplary embodiment, lower surface 112 of heel portion 104 and arch portion 108 includes a lower concave surface with respect to a ground surface.

In some embodiments, sole 105 includes upper surface 114. In some cases, upper surface 114 may be disposed adjacent to upper 102. Furthermore, sole 105 may be configured with sidewall portion 115. The term "sidewall portion" as used throughout this detailed description and in the claims refers to an outer portion of sole 105 that extends from lower surface 112 to upper surface 114. In other words, sidewall portion 115 may extend between upper 102 and lower surface 112. With this configuration, sidewall portion 115 may circumscribe sole 105.

For consistency and convenience, directional adjectives are employed throughout this detailed description corresponding to the illustrated embodiments. The term "longitudinal" as used throughout this detailed description and in the claims refers to a direction extending a length of a sole of an article. In some cases, the longitudinal direction may extend from a forefoot portion to a heel portion of a sole. Also, the term "lateral" as used throughout this detailed description and in the claims refers to a direction extending a width of a sole. In other words, the lateral direction may extend between a medial and a lateral side of a sole. Furthermore, the term "vertical" as used throughout this detailed description and in the claims refers to a direction generally perpendicular to a lateral and longitudinal direction. For example, in cases where a sole is planted flat on a ground surface, the vertical direction may extend from the ground surface upward.

An article of footwear can include provisions for supporting a sole of the article of footwear. In some embodiments, an article of footwear may include a plate to provide additional support and structure for a sole. In some cases, an article of footwear may include a curved plate that conforms to contours of a lower surface of a sole. In other cases, an article of footwear may include a plate with large gaps that reduce the weight of the plate. In an exemplary embodiment, an article of footwear can include a curved plate with large gaps. With this arrangement, the curved plate can provide structure and support to the sole without greatly increasing the weight of the sole.

Referring to FIGS. 1-3, sole 105 may be associated with curved plate 120. In different embodiments, curved plate 120 may comprise different shapes and sizes. In some embodiments, curved plate 120 may comprise a frame-like shape with large gaps. In some cases, curved plate 120 may extend longitudinally a portion of a length of sole 105. In other cases, curved plate 120 may extend longitudinally over a substantial entirety of the length of sole 105. In an exemplary embodiment, curved plate 120 may be configured with a frame-like shape that extends a substantial entirety of a length of sole 105.

In some embodiments, curved plate 120 may have a substantially consistent width. In other embodiments, curved plate 120 may be wider in some portions than other portions. In some cases, curved plate 120 may be wider at forefoot portion 103 than arch portion 108 and heel portion 104. In one embodiment, curved plate 120 may be wider at heel portion 104 and narrower at arch portion 108 and forefoot portion 103.

In some embodiments, curved plate 120 includes peripheral portion 122 and base portion 121. In some cases, peripheral portion 122 may include frame base portion 121. As peripheral portion 122 frames base portion 121, curved plate 120 may be configured with large gaps. With this arrangement, curved plate 120 can provide structure and support to sole 105 without greatly increasing the weight of sole 105.

Generally, peripheral portion 122 of curved plate 120 may be associated with peripheral sole portion 199 of sole 105. In one embodiment, peripheral portion 122 includes medial peripheral portion 126 and lateral peripheral portion 127. In some cases, medial peripheral portion 126 may be associated with medial portion 106 of peripheral sole portion 199. Likewise, lateral peripheral portion 127 may be associated with lateral portion 107 of peripheral sole portion 199. Peripheral portion 122 may also include rear peripheral portion 124 and forefoot peripheral portion 123. Rear peripheral portion 124 may be associated with heel portion 104 of peripheral sole portion 199. Similarly, forefoot peripheral portion 123 may be associated with forefoot portion 103 of sole 105. With this configuration, peripheral portion 122 may frame base portion 121. In an exemplary embodiment, medial peripheral portion 126, lateral peripheral portion 127, and rear peripheral portion 124 may form a continuous U-shaped ring framing base portion 121 throughout heel portion 104 and extending into medial portion 106 and lateral portion 107.

In some embodiments, base portion 121 may comprise portions that may be associated with different portions of sole 105. In one embodiment, base portion 121 includes angled portions 130 and central portion 140. In some embodiments, angled portions 130 may be associated with forefoot portion 103 of sole 105. Similarly, central portion 140 may be associated with arch portion 108 and heel portion 104 of sole 105.

In different embodiments, angled portions 130 may be configured with different shapes. Examples of shapes include, but are not limited to: square shapes, rectangular shapes, elliptical shapes, triangular shapes, regular shapes, irregular shapes as well as other types of shapes. In an exemplary embodiment, angled portions 130 may comprise a curved wave-like shape.

Angled portions 130 may also be configured with different sizes. In some embodiments, angled portions 130 may be relatively wide and cover a substantial portion of forefoot portion 103. In other embodiments, angled portions 130 may be relatively narrow. In some cases, angled portions 130 may protrude from lower surface 112 of sole 105. In other cases, angled portions 130 may be recessed with respect to a ground surface. In still other cases, angled portions 130 may be relatively flat with respect to a ground surface. In one embodiment, angled portions 130 may be relatively narrow and flat with respect to a ground surface.

With a relatively narrow configuration of angled portions 130, curved plate 120 may include gaps on either side of angled portions 130. Referring to FIG. 3, curved plate 120 includes medial gap 146 and lateral gap 147. Medial gap 146 may be disposed between angled portions 130 and medial peripheral portion 126. In a similar manner, lateral gap 147 may be disposed between angled portions 130 and lateral peripheral portion 127. Using this configuration, medial gap 146 and lateral gap 147 may decrease the weight of curved plate 120.

As previously discussed, base portion 121 also includes central portion 140. In some embodiments, central portion 140 may be configured with a concave shape, as illustrated in FIG. 3. In some cases, central portion 140 may include peak 141. In particular, peak 141 may be a portion that is disposed highest in a vertical direction when article 100 is disposed against a ground surface.

Central portion 140 may also include gaps to decrease the weight of curved plate 120. It is also possible that gaps may increase the flexibility of sole 105. In some embodiments, central portion 140 includes first gap 142. In different embodiments, first gap 142 may be associated with different portions of sole 105. In an exemplary embodiment, first gap 142 may be associated with arch portion 108. This can allow first gap 142 to increase the flexibility of arch portion 108. Using this arrangement, first gap 142 may decrease the weight of curved plate 120.

In order to increase the structural integrity of curved plate 120, base portion 121 and peripheral portion 122 may be connected. In different embodiments, base portion 121 and peripheral portion 122 may be connected in different manners. For example, in one embodiment, angled portions 130 of base portion 121 may be connected to peripheral portion 122 at forefoot peripheral portion 123. Furthermore, in some embodiments, curved plate 120 can include at least one leg portion that may join central portion 140 to peripheral portion 122.

Generally, curved plate 120 may include any number of leg portions that join central portion 140 to peripheral portion 122. In one embodiment, curved plate 120 includes three leg portions. In particular, curved plate 120 includes first leg portion 151, second leg portion 152 and third leg portion 153, also referred to collectively as plurality of leg portions 150, for purposes of clarity.

Plurality of leg portions 150 can extend outward from central portion 140 to peripheral portion 122. Referring to FIG. 3, first leg portion 151 may include first end portion 161 and second end portion 162. In some cases, first end portion 161 may be disposed adjacent to medial peripheral portion 126 and second end portion 162 may be disposed adjacent to central portion 140. Similarly, second leg portion 152 may include first end portion 171 and second end portion 172. First end portion 171 may be disposed adjacent to rear peripheral portion 124 and second end portion 172 may be disposed adjacent to central portion 140. Finally, third leg portion 153 can include first end portion 181 and second end portion 182. First end portion 181 may be disposed adjacent to lateral peripheral portion 127 and second end portion 182 may be disposed adjacent to central portion 140. In other words, each leg portion of plurality of leg portions 150 may extend outward from central portion 141 to join a portion of peripheral portion 122.

In embodiments where central portion 140 is configured with a concave shape, the relative height of plurality of leg portions 150 may decrease as plurality of leg portions 150 extends outward from central portion 140. For example, the relative height of first leg portion 151 decreases in a vertical direction as first leg portion 151 extends outward from central portion 140. In other words, second end portion 162 may have a greater height in a vertical direction than first end portion 161 of first leg portion 151. Similarly, the relative height of second leg portion 152 and third leg portion 153 also decreases in a vertical direction as second leg portion 152 and third leg portion 153 extend outward from central portion 140.

In different embodiments, leg portions of plurality of leg portions 150 may be configured with different shapes. In some embodiments, each leg portion of plurality of leg portions 150 may comprise a shape with a constant width. In other embodiments, each leg portion of plurality of leg portions 150 may be tapered at a first end portion and/or a second portion. In still other embodiments, each leg portion of plurality of leg portions 150 may be wider at a first end portion and/or a second end portion. In an exemplary embodiment, each leg portion of plurality of leg portions 150 may be wider at a first end portion and a second end portion and narrower at an intermediate portion disposed between the first end portion and second end portion.

In one embodiment, first leg portion 151 includes first intermediate portion 163. First intermediate portion 163 may be disposed between first end portion 161 and second end portion 162. Furthermore, first intermediate portion 163 may be tapered so that first intermediate portion 163 is thinner than first end portion 161 and second end portion 162. Similarly, second leg portion 152 and third leg portion 153 may be configured with intermediate portions than are thinner than first end portions and second end portions. This configuration increases the flexibility of plurality of leg portions 150 as plurality of leg portions 150 extend outward from central portion 140 to peripheral portion 122. This may allow central portion 140 to flex with respect to peripheral portion 122.

Furthermore, plurality of leg portions 150 allows curved plate 120 to provide support and structure to sole 105 while being light weight. In particular, curved plate 120 may be configured with gaps between plurality of leg portions 150 that may decrease the weight of curved plate 120. In one embodiment, curved plate 120 includes second gap 143 and third gap 144. In some cases, second gap 143 may be disposed between first leg portion 151 and second leg portion 152. Similarly, third gap 144 may be disposed between second leg portion 152 and third leg portion 153. With this arrangement, curved plate 120 can provide support and structure to sole 105 while being light weight.

A sole of an article of footwear can include provisions for receiving a curved plate. In some embodiments, a sole may include cavities for receiving a curved plate. In some cases, a lower surface of a sole may include cavities for receiving a curved plate. In other cases, a sidewall portion of a sole may include cavities for receiving a curved plate. In an exemplary embodiment, a lower surface and a side wall portion of a sole may include cavities for receiving a curved plate.

As previously discussed, heel portion 104 and arch portion 108 of sole 105 may be configured with a lower concave surface. This lower concave surface may be configured to receive a concave shape of central portion 140 of curved plate 120. Using this arrangement, central portion 140 of curved plate 120 can confront lower surface 112 of heel portion 104 and arch portion 108 as sole 105 receives curved plate 120.

In some embodiments, forefoot portion 103 may also include a cavity to receive curved plate 120. In some cases, forefoot portion 103 may include a recess to receive angled portions 130 of curved plate 120. In other embodiments, angle portions 130 may be disposed on a substantially flat lower surface 112 of forefoot portion 103. With this configuration, curved plate 120 may fit against lower surface 112 of sole 105.

Figure 4:
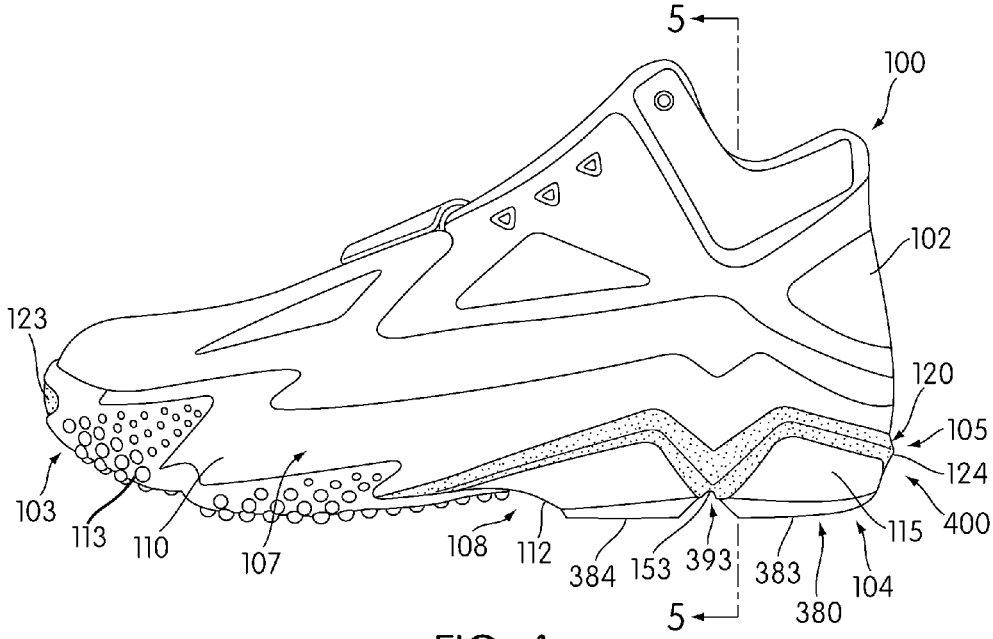
FIG. 4 is a side view of an exemplary embodiment of an article of footwear with a heel cushioning system.

Referring to FIGS. 3 and 4, sidewall portion 115 of sole 105 may also be configured to receive a portion of curved plate 120. In some embodiments, sidewall portion 115 may include a plurality of cavities to receive peripheral portion 122. For example, sidewall portion 115 may be configured with recesses on medial portion 106, lateral portion 107, forefoot portion 103 as well as heel portion 104 to receive medial peripheral portion 126, lateral peripheral portion 127, forefoot peripheral portion 123 and rear peripheral portion 124, respectively. In other embodiments, however, sidewall portion 115 may receive peripheral portion 122 without recesses or cavities. This configuration allows peripheral portion 122 to extend around sidewall portion 115 as sole 105 receives curved plate 120.

After sole 105 receives curved plate 120, curved plate 120 may be secured to sole 105. Generally, this may be accomplished in any manner known in the art. In some embodiments, curved plate 120 may be secured to sole 105 through adhesives. In other embodiments, curved plate 120 may be secured to sole 105 through a plurality of fasteners, including, but not limited to: nails, tacks, bolts, and other types of fasteners. In still other embodiments, curved plate 120 may be secured to sole 105 through stitching. Because much of the curved plate 120 is open to the ground, rather than being secured in place with an overlying outsole, it is desirable that the method of attachment be selected to be able to secure the curved plate 120 to the sole 105 without significant support.

With curved plate 120 secured to sole 105, outsole 113 of sole 105 may be applied adjacent to curved plate 120. In other words, outsole 113 of sole 105 may be disposed on top of curved plate 120 so that outsole 113 may contact a ground surface. In some cases, outsole 113 may be associated with gaps in curved plate 120. It is desirable that that any portion of the outsole 113 that is disposed on top of the curved plate 120 be positioned in the forefoot area. Among the reasons for the inclusion of an outsole interposed between the curved plate 120 and the ground may be to protect the curved plate 120 from damage from impact with the ground. Because of the configuration of the sole as a whole, the use of an outsole partially covering the curved plate may be positioned in the forefoot area in a preferred embodiment.

Generally, outsole 113 may be associated with any combination of gaps in curved plate 120. In one embodiment, outsole 113 may include medial outsole portion 116 and lateral outsole portion 117. In some cases, medial outsole portion 116 may be associated with medial gap 146 of curved plate 120. Likewise, lateral outsole portion 117 may be associated with lateral gap 147 of curved plate 120. With this arrangement, medial outsole portion 116 and lateral outsole portion 117 may be disposed one either side of angled portions 130.

In different embodiments, medial outsole portion 116 and lateral outsole portion 117 may be configured with different shapes. In some embodiments, medial outsole portion 116 and lateral outsole portion 117 may comprise shapes substantially similar to the shapes of medial gap 146 and lateral gap 147. In other embodiments, medial outsole portion 116 and lateral outsole portion 117 may comprise shapes different from the shapes of medial gap 146 and lateral gap 147. In one embodiment, medial outsole portion 116 and lateral outsole portion 117 may be configured with shapes that do not extend into arch portion 108. In other words, medial outsole portion 116 and lateral outsole portion 117 may be shaped to fit forefoot portion 103 on either side of angled portions 130. This may allow portions of medial gap 146 and lateral gap 147 to remain visible on lower surface 112 of arch portion 108.

In some embodiments, medial outsole portion 116 and lateral outsole portion 117 may include provisions to increase the traction and flexibility of sole 105. In some cases, medial outsole portion 116 and lateral outsole portion 117 may be configured to wrap around sidewall portion 115 of sole 105. This can increase the traction capabilities of sole 105 on sidewall portion 115. In addition, medial outsole portion 116 and lateral outsole portion 117 may include cutout portions 118. Cutout portions 118 can enable bending of medial outsole portion 116 and lateral outsole portion 117. With this arrangement, medial outsole portion 116 and lateral outsole portion 117 may include provisions to increase the traction and flexibility of sole 105.

As previously discussed, portions of sole 105 may appear through gaps in curved plate 120. Referring to FIGS. 1 and 2, midsole 110 of sole 105 may appear through gaps in curved plate 120. In particular, midsole 110 may be visible through first gap 142 adjacent to arch portion 108. In some cases, midsole 110 may also be visible in portions of forefoot portion 103 and heel portion 104. For example, midsole 110 may be visible through second gap 143 and third gap 144 between plurality of leg portions 150 of curved plate 120. Also, midsole 110 may appear through portions of medial gap 146 and lateral gap 147 not covered by medial outsole portion 116 and lateral outsole portion 117, respectively.

A sole can include provisions for maintaining traction and raising a heel portion of the sole slightly above a ground surface. In some embodiments, a sole may include tread members to increase the traction capabilities of the sole. The term "tread member" as used throughout this detailed description and in the claims refers to a portion of a sole that is configured to engage a ground surface. In some cases, tread members may be configured so that the tread members also raise a heel portion of the sole above a ground surface.

In some embodiments, sole 105 may be associated with plurality of tread members 380. In some cases, midsole 110 may be configured with plurality of tread members 380. In order to engage a ground surface, plurality of tread members 380 may fit through gaps in curved plate 120 as sole 105 is assembled.

In different embodiments, plurality of tread members 380 may include a different number of tread members. In an exemplary embodiment, plurality of tread members 380 includes four tread members. In particular, plurality of tread members 380 comprises first tread member 381, second tread member 382, third tread member 383 and fourth tread member 384.

In embodiments including plurality of tread members 380, tread members may be associated with different portions of sole 105. In one embodiment, plurality of tread members 380 may be associated with a peripheral portion of heel portion 104 of sole 105. In particular, first tread member 381 and second tread member 382 may be associated with medial portion 106 of heel portion 104. Likewise, third tread member 383 and fourth tread member 384 may be associated with lateral portion 107 of heel portion 104. With this arrangement, plurality of tread members 380 can increase traction for heel portion 104.

In different embodiments, plurality of tread members 380 may be configured with different shapes including, but not limited to: to square shapes, rectangular shapes, elliptical shapes, triangular shapes, regular shapes, irregular shapes as well as other types of shapes. In some embodiments, plurality of tread members 380 may be configured with generally rectangular shapes. In some cases, tread members may comprise a greater length than width. Furthermore, plurality of tread members 380 may be configured with sufficient height to raise heel portion 104 above a ground surface. In one embodiment, tread members may be slightly tapered at end portions that confront a ground surface. This configuration may assist in providing traction to sole 105. With this arrangement, plurality of tread members 380 can provide traction as well as raise heel portion 104 slightly above a ground surface.

In some embodiments, plurality of tread members 380 may be separated. In other words, plurality of tread members 380 may be arranged with gaps between tread members. In one embodiment, first tread member 381 may be separated from second tread member 382 by first tread member gap 391. Similarly, second tread member 382 may be separated from third tread member 383 by second tread member gap 392. Also, third tread member 383 may be separated from fourth tread member 384 by third tread member gap 393.

As curved plate 120 is associated with sole 105, plurality of tread members 380 may fit within gaps in curved plate 120. Referring to FIG. 3, first tread member 381 may fit within a portion of medial gap 146. Second tread member 382 may be disposed within second gap 143. In addition, third tread member 383 may be disposed within third gap 144. Finally, fourth tread member 384 may be associated with a portion of lateral gap 147.

Furthermore, as plurality of tread members 380 are inserted through curved plate 120, plurality of leg portions 150 may extend through gaps between plurality of tread members 380. Referring to FIGS. 1-3, plurality of leg portions 150 extend to peripheral portion 122 through gaps between plurality of tread members 380. In some cases, first end portions of plurality of leg portions 150 may be disposed adjacent to gaps between plurality of tread members 380. For example, first end portion 161 of first leg portion 151 may be disposed adjacent to first tread member gap 391. Likewise, first end portion 171 of second leg portion 152 may be disposed adjacent to second tread member gap 392. In a similar manner, first end portion 181 of third leg portion 153 may be disposed adjacent to third tread member gap 393. With this arrangement, the structural integrity of the connection between central portion 140 and peripheral portion 122 can be strengthened as plurality of leg portions 150 extend through gaps between plurality of tread members 380. It is noted that the tread members 380 may be spaced from one another. The curved plate 120 may be designed to be positioned between the tread members 380 and open to the ground in the area between the tread members. The tread members 380 may be designed to not overlap the edges of the curved plate 120.

In some embodiments, plurality of tread members 380 may include additional provisions to strengthen the structural integrity of central portion 140 and peripheral portion 122. In one embodiment, plurality of tread members 380 may include support ribs 250. Support ribs 250 may extend from plurality of tread members 380 over midsole 110 to central portion 140.

In different embodiments, support ribs 250 may be configured in different shapes. In one embodiment, support ribs 250 may comprise blade-like portions that extend from plurality of tread members 380 to central portion 140. In some cases, central portion 140 may be configured with similar blade-like protrusions that correspond with support ribs 250. Using this arrangement, support ribs 250 may increase the structural stability of curved plate 120.

An article may include a heel cushioning system to provide support and resilience to a heel portion of a sole. In some embodiments, a heel cushioning system may comprise a sole, a curved plate and a plurality of tread members. In some cases, the plurality of tread members may raise a heel portion of a sole above a ground surface. With the heel portion suspended over a ground surface, the curved plate can support the heel portion while providing flexibility to the sole. In particular, the curved plate can deflect when a force is applied to the sole. With this arrangement, the heel cushioning system can provide support and resiliency to the heel portion of the sole.

Figure 5:
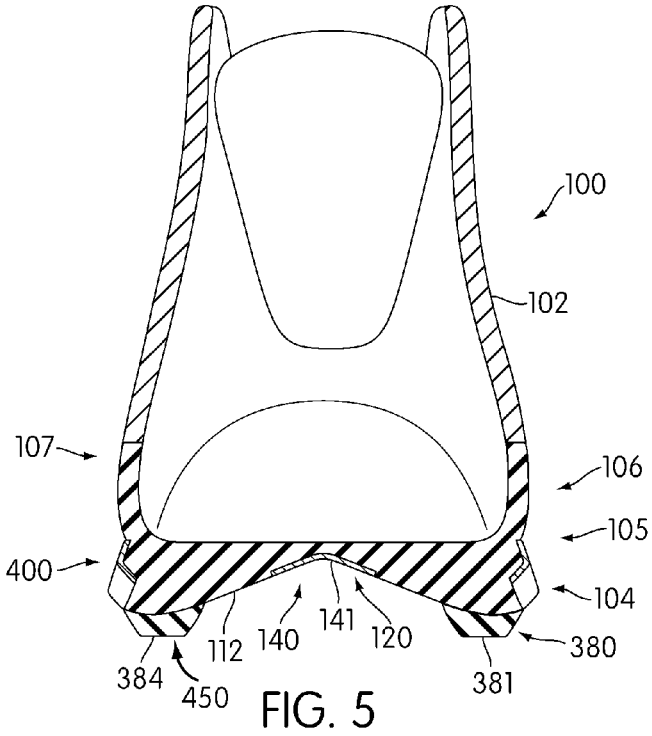
FIG. 5 is a cross sectional view of an exemplary embodiment of an article of footwear with a heel cushioning system.

In one embodiment, the various components of article of footwear 100 may comprise heel cushioning system 400. Referring to FIGS. 4 and 5, heel cushioning system 400 includes sole 105, curved plate 120 and plurality of tread members 380. As previously discussed, plurality of tread members 380 may increase the distance between lower surface 112 of sole 105 and a ground surface. For example, FIG. 4 illustrates an embodiment of third tread member 383 and fourth tread member 384 raising lower surface 112 of heel portion 104 above a ground surface. In a cross sectional view, FIG. 5 illustrates an embodiment of first tread member 381 and fourth tread member 384 raising lower surface 112 of heel portion 104 above a ground surface. It should be understood that the remaining tread members of plurality of tread members 380 may be configured to raise heel portion 104 above a ground surface. With this configuration, central portion 140 of curved plate 120 may be suspended over a ground surface by plurality of tread members 380.

With central portion 140 suspended over a ground surface, curved plate 120 may be configured for deflection when a force is applied to an upper surface of sole 105. In some embodiments, curved plate 120 may include deflection properties that allow central portion 140 to behave in a spring-like manner.

In different embodiments, peak 141 may extend different distances vertically from an outer sole surface. The term "outer sole surface" as used throughout this detailed description and in the claims refers to a surface that is configured to engage a ground surface. In some cases, an outer sole surface can correspond to the outer surface of a midsole or an outsole. In other cases, the outer sole surface may correspond to the outer surface of one or more cleats or tread members.

In some embodiments, peak 141 may be raised from outer sole surface 450 by a value in the range between 0.10 inch and 2 inches. In an exemplary embodiment, peak 141 may be raised from outer sole surface 450 by a value of approximately 1 inch. In other words, peak 141 may be raised above a ground surface by approximately 1 inch when sole 105 is disposed on the ground surface.

Figure 6:
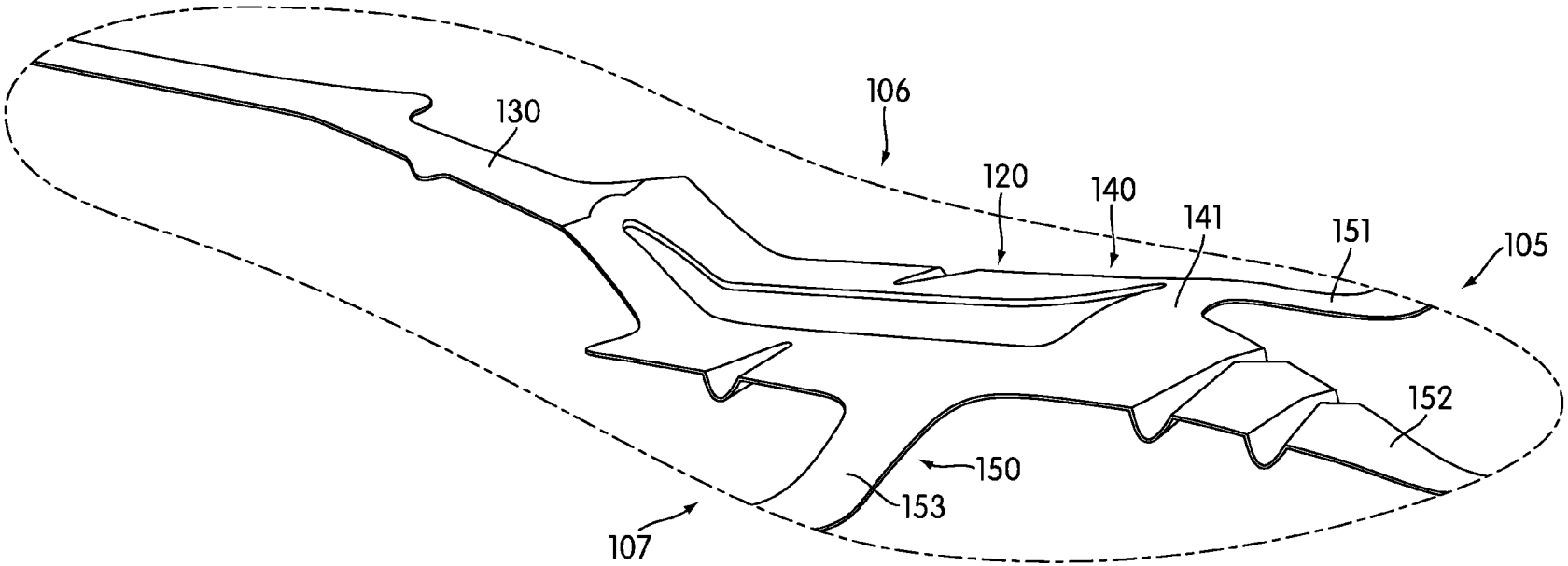
FIG. 6 is an isometric view of an exemplary embodiment of a curved plate in a non-deflected state.

Referring to FIG. 6, central portion 140 may be configured with a substantially concave shape when curved plate 120 is in a non-deflected state. The term "non-deflected state" as used throughout this detailed description and in the claims refers to a state in which central portion 140 is unstressed. In addition, peak 141 may extend upward when curved plate 120 is in a non-deflected state. As central portion 140 is disposed in a substantially concave shape, plurality of leg portions 150 may also extend upward as plurality of leg portions 150 join central portion 140. In particular, plurality of leg portions 150 may anchor central portion 140 so that central portion 140 is not free floating. By anchoring central portion 140 with plurality of leg portions 150 instead of extending central portion 140 over a substantial entirety of heel portion 104, central portion 140 may deflect with greater ease when a force is applied.

Figure 7:
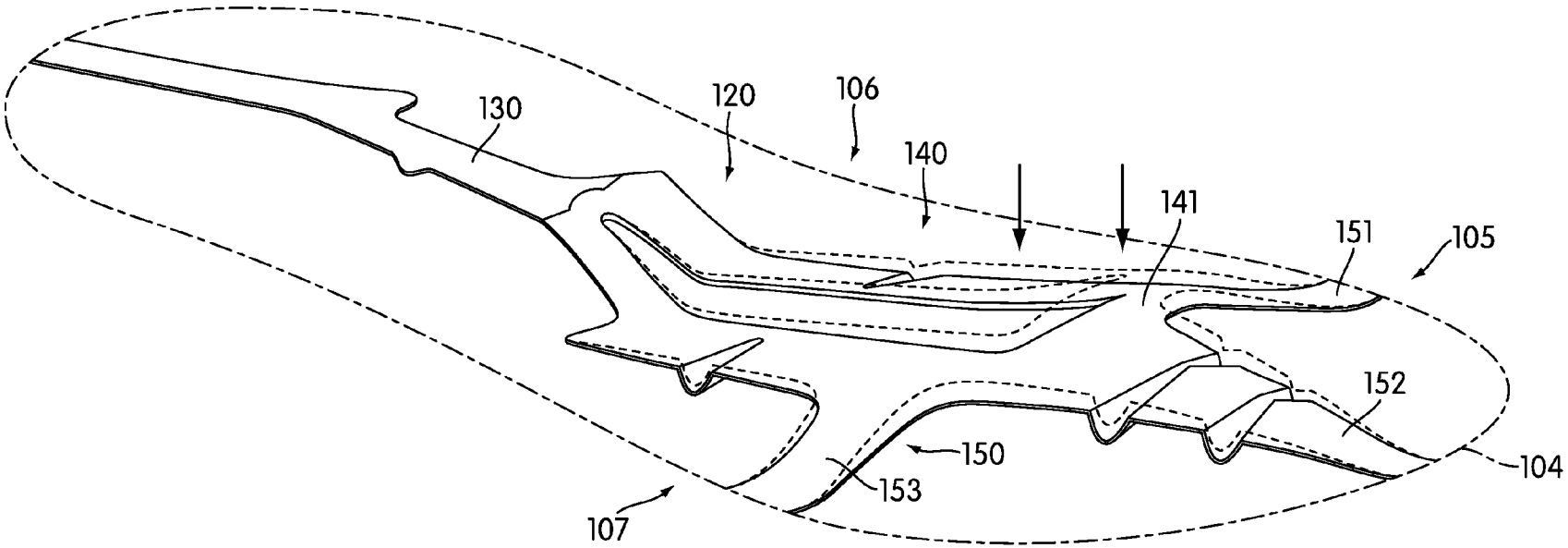
FIG. 7 is an isometric view of an exemplary embodiment of a curved plate in a deflected state.

When a force is applied to an upper surface of sole 105, central portion 140 may deflect downward to a deflected state, as illustrated in FIG. 7. The term "deflected state" as used throughout this detailed description and in the claims refers to a state in which central portion 140 has been deformed in a generally vertical manner. As central portion 140 deflects downward, peak 141 may flatten. For purposes of clarity, FIG. 7 illustrates an embodiment of the position of central portion 140 in a non-deflected state.

In some embodiments, plurality of leg portions 150 may facilitate the deflection of curved plate 120 when a force is applied. This can be achieved by the downward deflection of plurality of leg portions 150 when the force is applied. In some cases, thin intermediate portions of plurality of leg portions 150 may flex downward to facilitate the deflection of central portion 140.

When the force is removed, curved plate 120 may be resilient and recover to a non-deflected state. In other words, central portion 140 may recover to a substantially concave shape when a force is removed. Also, plurality of leg portions 150 may move upward as central portion 140 returns to a substantially concave shape. Using this arrangement, heel cushioning system 400 can provide support and resiliency to heel portion 104 of sole 105.

In different embodiments, portions of heel cushioning system 400 may be configured with different relative rigidities to allow for variation in the deformation properties of heel cushioning system 400. For example, in one embodiment sole 105 may be more rigid than curved plate 120. In another embodiment, however, curved plate 120 may be more rigid than sole 105. In still another embodiment, curved plate 120 and sole 105 may have substantially similar rigidities.

Furthermore, in some cases, tread members 380 may be more rigid than both sole 105 and curved plate 120. This arrangement helps prevent tread members 380 from being compressed as forces are applied to an article. By altering the relative rigidities of portions of heel cushioning system 400, the deflection properties of heel cushioning system 400 may be fine tuned.

Generally, each component of heel cushioning system 400 may be constructed of any material. For example, components of heel cushioning system 400 may be constructed from any suitable material, including but not limited to: elastomers, siloxanes, natural rubber, other synthetic rubbers, aluminum, steel, natural leather, synthetic leather, or plastics.

Upper 102 of article 100 may be made from any suitable material. Examples of suitable materials for upper 102, include but are not limited to: nylon, natural leather, synthetic leather, natural rubber, or synthetic rubber. Furthermore, upper 102 can be made of any suitable knitted, woven or non-woven material.

Figure 8:
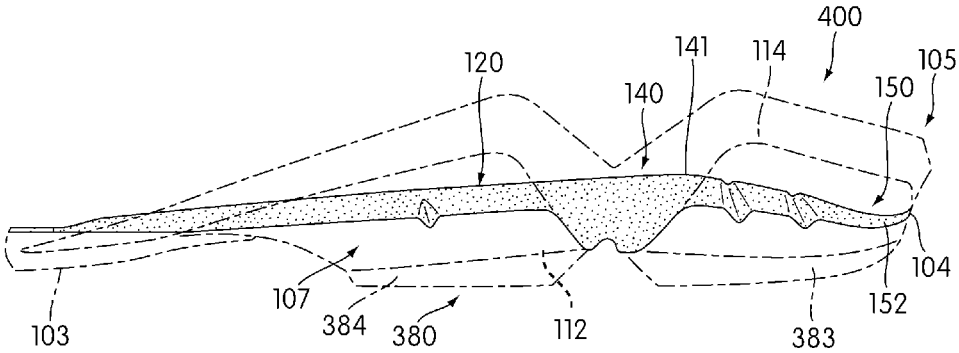
FIG. 8 is a side isometric view of an exemplary embodiment of a curved plate of a heel cushioning system in a non-deflected state.
Figure 9:
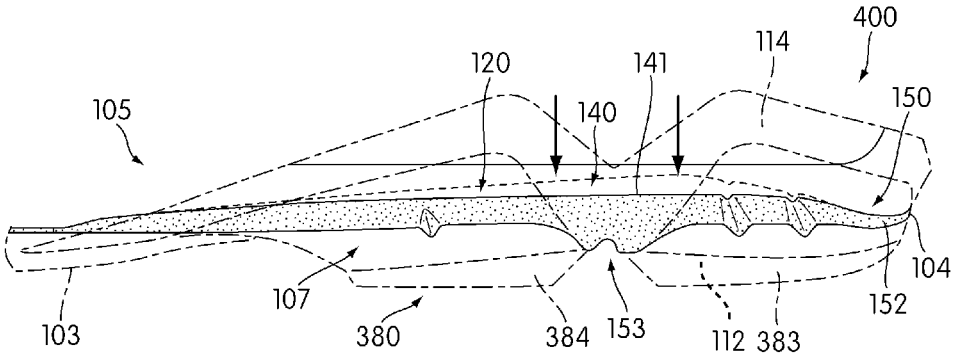
FIG. 9 is a side isometric view of an exemplary embodiment of a curved plate of a heel cushioning system in a deflected state.
Figure 10:
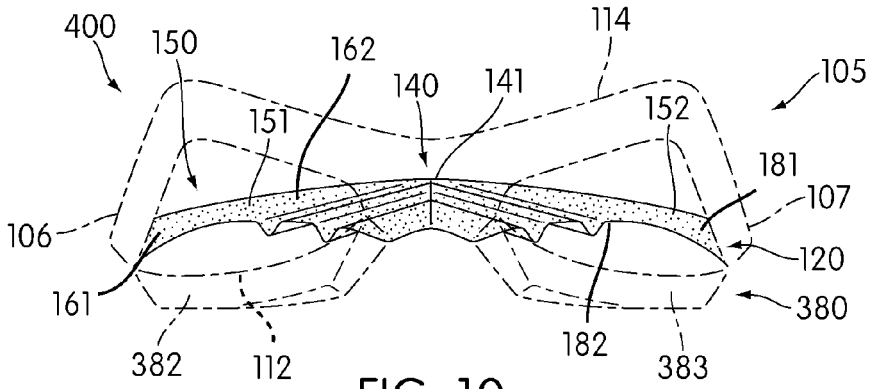
FIG. 10 is a front isometric view of an exemplary embodiment of a curved plate of a heel cushioning system in a non-deflected state.
Figure 11:
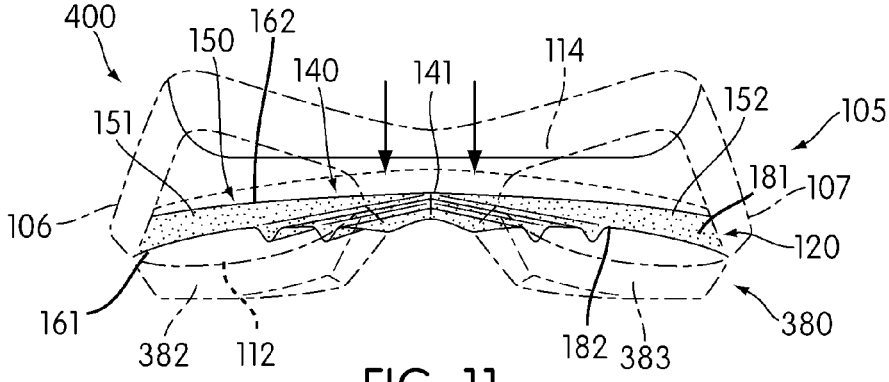
FIG. 11 is a front isometric view of an exemplary embodiment of a curved plate of a heel cushioning system in a deflected state.

FIGS. 8-11 illustrate exemplary embodiments of heel cushioning system 400. FIGS. 8 and 9 illustrate side isometric views of an exemplary embodiment of heel cushioning system 400 and FIGS. 10 and 11 illustrate front isometric views of an exemplary embodiment of heel cushioning system 400. For purposes of clarity, sole 105 is illustrated in phantom in FIGS. 8-11. In addition, article 100 is not illustrated in these Figures for purposes of illustration.

Referring to FIGS. 8 and 10, curved plate 120 may be disposed in a non-deflected state. In some embodiments, curved plate 120 may be disposed in a non-deflected state when a force is not applied to upper surface 114 of sole 105. For example, in some cases, curved plate 120 may be disposed in a non-deflected state when a wearer of article 100, not shown for purposes of illustration, stands upright.

As previously discussed, central portion 140 may comprise a substantially concave shape when curved plate 120 is in a non-deflected state. With this configuration, peak 141 may extend upward as curved plate 120 is in a non-deflected state. Furthermore, when curved plate 120 is in a non-deflected state, plurality of leg portions 150 may extend substantially downward as plurality of leg portions 150 extend outward from central portion 140.

As an athlete maneuvers, forces may be applied to a sole of an article of footwear. For example, in some cases, a downward force may be applied to a sole of an article of footwear when an athlete takes a hard step during walking or running. Without provisions for deflection, a sole may receive substantial impact from the downward force. In contrast, a heel cushioning system may provide deflection properties for a sole. With a heel cushioning system, a sole can deflect to accommodate and lessen an impact from a force applied to the sole. It is noted that a downward force may not be a force perpendicular to the ground. Instead, depending on the foot strike and configuration of the sole elements, the force applied through a foot strike may be at a variety of angles to the ground.

Referring to FIGS. 9 and 11, a downward force is applied to upper surface 114 of sole 105. When a downward force is applied to upper surface 114, plurality of tread members 380 may not compress due to the rigidity of plurality of tread members 380. This allows lower surface 112 of heel portion 104 to remain suspended above a ground surface as a force is applied to upper surface 114. However, midsole 110 may deform in response to the downward force on upper surface 114.

With the deformation of midsole 110, curved plate 120 may be configured in a deflected state. In the deflected state, central portion 140 of curved plate 120 may flex downward. In particular, peak 141 may be compressed and flatten when curved plate 120 is in a deflected state. With this configuration, curved plate 120 can deflect and absorb some of the force applied to upper surface 114.

In some cases, plurality of leg portions 150 may deflect in a substantially vertical direction as a downward force is applied to sole 105. Referring to FIGS. 10 and 11, for example, the vertical distance between first end portion 161 and second end portion 162 of first leg portion 151 is substantially reduced as curved plate 120 is deflected under a force. In a similar manner, the vertical distance between first end portion 181 and second end portion 182 of third leg portion 153 is substantially reduced as curved plate 120 is deflected. It should be understood that the vertical distance between the end portions of second leg portion 152 may also be reduced in a similar manner. With this arrangement, each leg portion of plurality of leg portions 150 may deflect in a substantially vertical manner to facilitate the deflection of curved plate 120. In some cases, each of the plurality of leg portions 150 may behave as compression springs that allow downward vertical deflection of central portion 140 and also provide a restoring force in the upward vertical direction.

After a downward force is removed, central portion 140 may recover to a non-deflected state, as illustrated in FIGS. 8 and 10. In particular, peak 141 of central portion 140 may be restored to extend vertically upward. Furthermore, plurality of leg portions 150 may be further extended in the vertical direction. Using this arrangement, heel cushioning system 400 may provide a restoring force to heel portion 104.

As previously discussed, the rigidities of a heel cushioning system may be altered to change the deformation properties of the heel cushioning system. For example, in some embodiments, a midsole may be made of a substantially compressible material. With a compressible material, the midsole may substantially compress when a force is applied to an upper surface of a sole. In some cases, substantial compression of the midsole may cause a curved plate to deflect in a manner that pushes a plurality of leg portions downward through gaps between a plurality of tread members.

Figure 12:
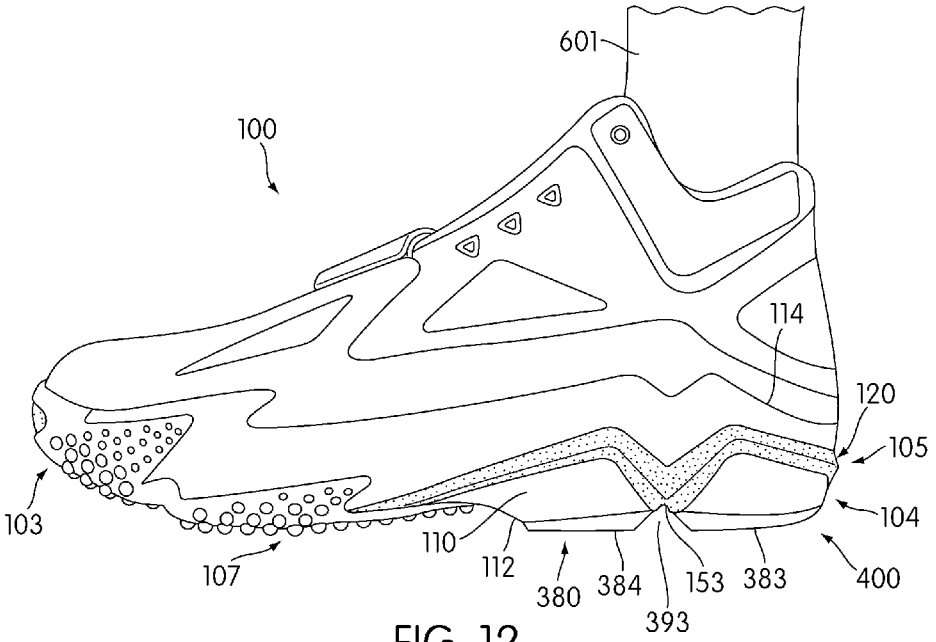
FIG. 12 is a side view of an exemplary embodiment of an athlete wearing an article of footwear with a compressible midsole and a curved plate of a heel cushioning system in a non-deflected state.
Figure 13:
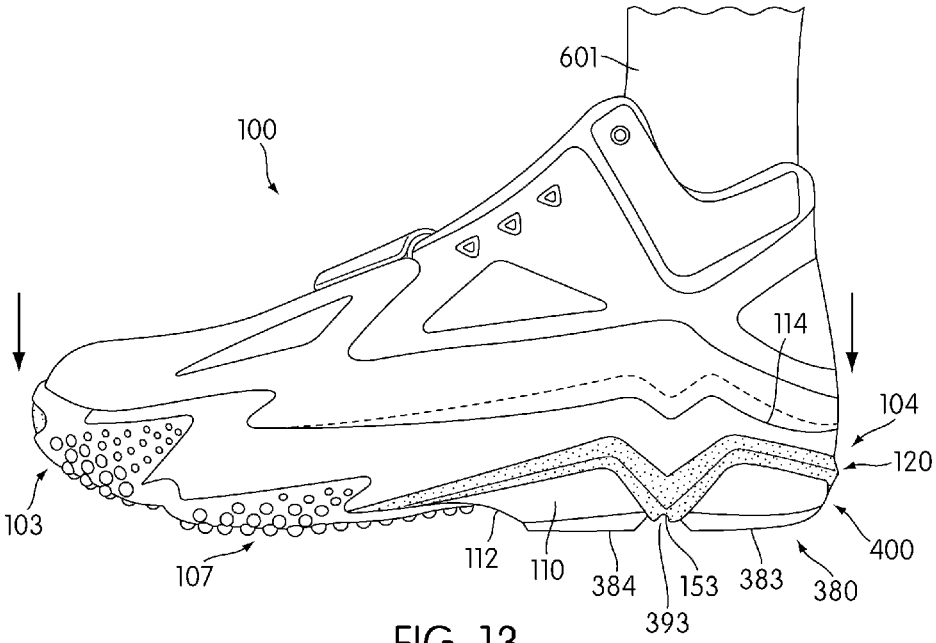
FIG. 13 is a side view of an exemplary embodiment of an athlete wearing an article of footwear with a compressible midsole and a curved plate of a heel cushioning system in a deflected state.

Referring to FIGS. 12 and 13, midsole 110 of sole 105 comprises a compressible material. FIG. 12 illustrates an exemplary embodiment of sole 105 in an unstressed condition. Without a force applied, the midsole 110 is not compressed and curved plate 120 is in a non-deflected state.

Referring to FIG. 13, a downward force is applied to upper surface 114 of sole 105. With a compressible material, midsole 110 compresses substantially as the downward force is applied. However, plurality of tread members 380 remain rigid and continue to suspended lower surface 112 of heel portion 104 above a ground surface. With this configuration, curved plate 120 moves to a deflected state in response to the force applied to upper surface 114.

In some cases, curved plate 120 may deflect so that plurality of leg portions 150 are pushed downward through gaps between plurality of tread members 380. For example, first end portion 181 of third leg portion 153 may be pushed downward through third tread member gap 393 between third tread member 383 and fourth tread member 384. The remaining leg portions of plurality of leg portions 150 may also be pushed downward through gaps between plurality of tread members 380. This arrangement of gaps can allow curved plate 120 to deflect to a greater extent to accommodate a force. With this configuration of gaps, curved plate 120 may be configured in a deflected state that accommodates the compression of midsole 110.

Although the current embodiment includes a curved plate configured to extend over the substantial entirety of a sole, other embodiments could include only portions of a curved plate. In other words, in some cases, portions of a curved plate can be optional. For example, in another embodiment, a curved plate may not include angled portions that are associated with a forefoot portion of a sole. Instead, the curved plate may be located throughout a heel portion and/or an arch portion of a sole only. In this other embodiment, a central portion of the curved plate may still facilitate cushioning in the heel of an article.

Figure 14:
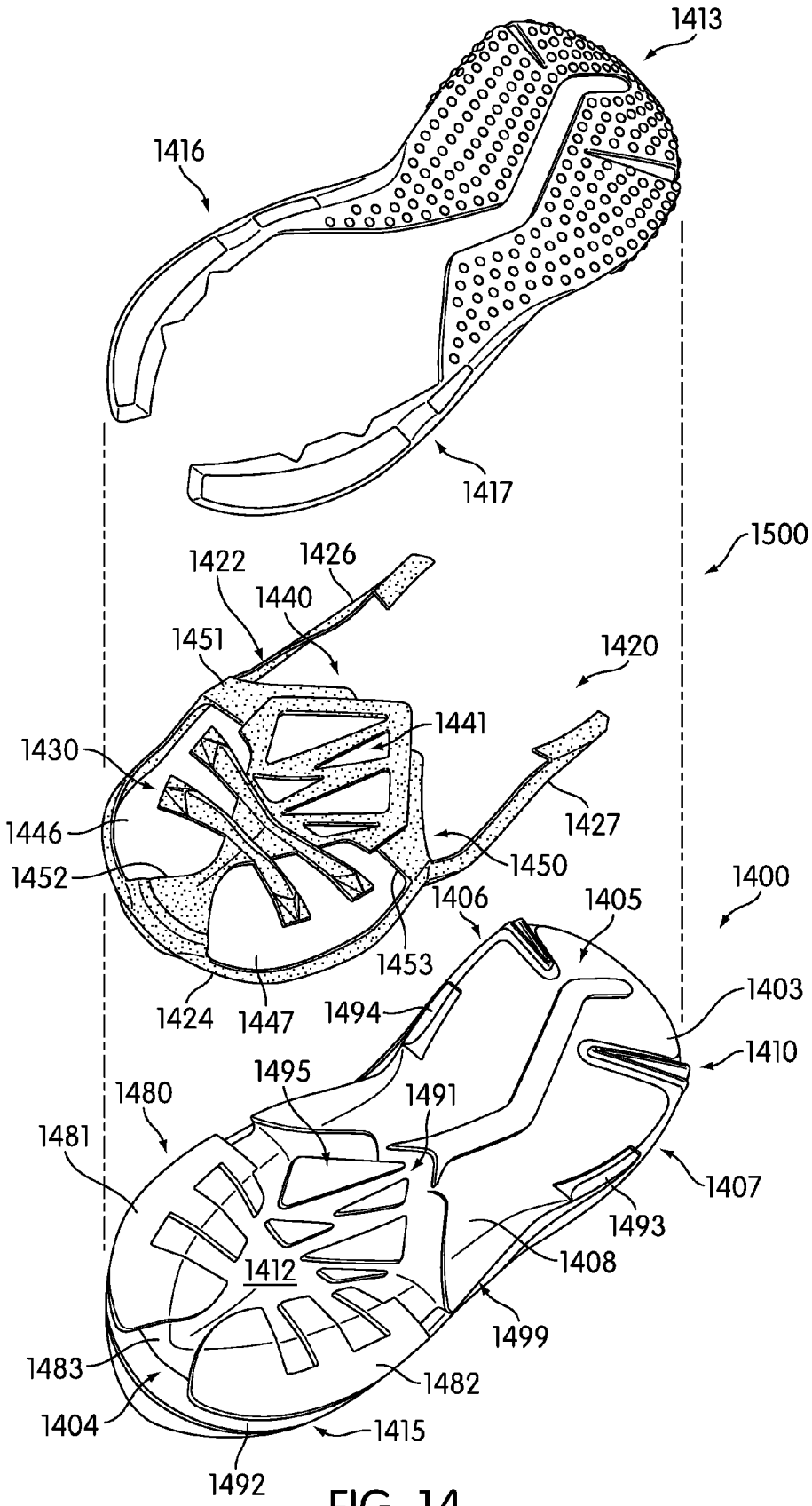
FIG. 14 is an exploded view of an exemplary embodiment of a heel cushioning system.

FIG. 14 is an exploded isometric view of an exemplary embodiment of article of footwear 1400. In one embodiment, the various components of article of footwear 1400, also referred to as article 1400, may comprise heel cushioning system 1500. In some cases, heel cushioning system 1500 includes sole 1405, curved plate 1420 and plurality of tread members 1480. In contrast to a previous embodiment where a curved plate extended into a forefoot portion of a sole, curved plate 1420 may be associated with arch portion 1408 and heel portion 1404 of sole 1405 only.

In some embodiments, curved plate 1420 includes central portion 1440 and peripheral portion 1422. In some cases, central portion 1440 may be configured with an approximately diamond-like shape. In addition, peripheral portion 1422 can be disposed outwards of central portion 1440 and substantially surround central portion 1440.

Central portion 1440 can include gaps to decrease the weight of curved plate 1420. In some embodiments, central portion 1440 may include one or more gaps. For example, in an exemplary embodiment, central portion 1440 can include plurality of gaps 1441.

In different embodiments, plurality of gaps 1441 may include different numbers of gaps configured with various sizes and shapes, including, but not limited to, square shapes, rectangular shapes, elliptical shapes, triangular shapes, regular shapes, irregular shapes as well as other types of shapes. In one embodiment, plurality of gaps 1441 can include approximately 5 gaps. In some cases, plurality of gaps 1441 may be configured with triangular shapes. This configuration can increase the flexibility of central portion 1440 and enhance the deflection properties of central portion 1440.

Figure 15:
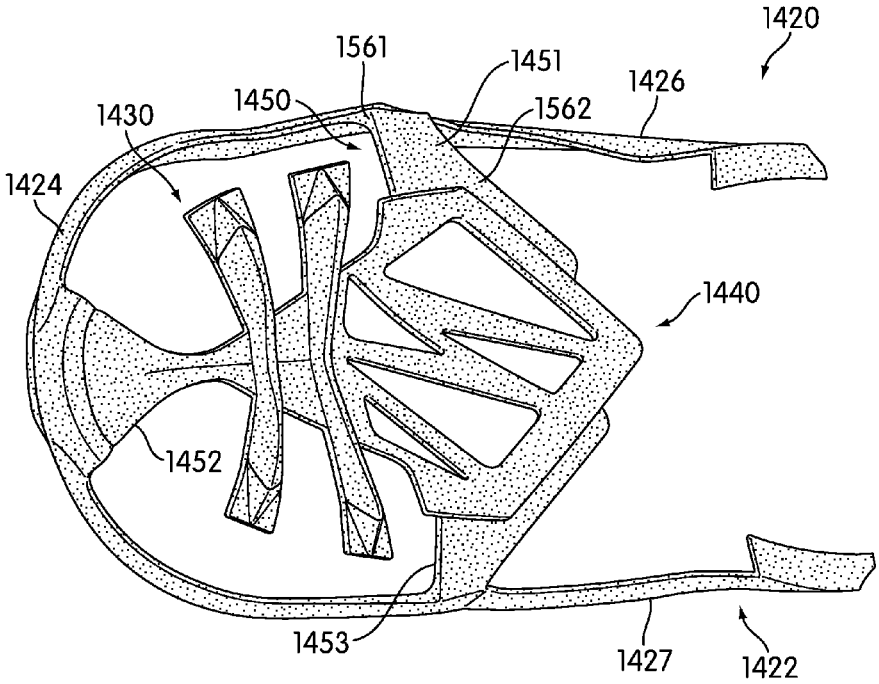
FIG. 15 is a top down view of an exemplary embodiment of a curved plate of a heel cushioning system.

In order to increase the structural integrity of curved plate 1420, central portion 1440 may be connected to peripheral portion 1422 by plurality of leg portions 1450, as illustrated in FIGS. 14 and 15. Generally, any number of leg portions may connect a central portion of a curved plate to a peripheral portion. In one embodiment, plurality of leg portions 1450 may comprise first leg portion 1451, second leg portion 1452, and third leg portion 1453. In some cases, first leg portion 1451 may extend outward from central portion 1440 to medial peripheral portion 1426 of peripheral portion 1422. In a similar manner, second leg portion 1452 may extend outward from central portion 1440 to rear peripheral portion 1424 of peripheral portion 1422. Likewise, third leg portion 1453 may extend outward from central portion 1440 to lateral peripheral portion 1427 of peripheral portion 1422. Using this configuration, plurality of leg portions 1450 may anchor central portion 1440 to peripheral portion 1422.

In some embodiments, a curved plate can include additional provisions to increase the structural stability of the curved plate. For example, a curved plate can include projecting portions to increase the structural stability of the curved plate. In an exemplary embodiment, curved plate 1420 includes projecting portions 1430.

Projecting portions 1430 extend outward from second leg portion 1452. In some cases, projecting portions 1430 include four projecting portions that extend outward from second leg portion 1452. However, in other cases, a curved plate can include more or less projecting portions to strengthen the structural stability of the curved plate. By extending outward from second leg portion 1452, projecting portions 1430 can increase the stability of second leg portion 1452 as second leg portion 1452 joins central portion 1440 and peripheral portion 1422. With the structural stability of curved plate 1420 strengthened, curved plate 1420 can provide support and structure to sole 1405.

Generally, sole 1405 can include different components including, but not limited to, an outsole, a midsole, and/or an insole. Referring to FIG. 14, sole 1405 includes outsole 1413 and midsole 1410. In an exemplary embodiment, heel portion 1404 and arch portion 1408 of midsole 1410 are configured with a lower concave surface with respect to a ground surface.

Furthermore, sole 1405 can include provisions for receiving curved plate 1420. In some embodiments, sole 1405 may be configured with cavities for receiving curved plate 1420. In other embodiments, sole 1405 may include protruding portions that may engage portions of curved plate 1420. In an exemplary embodiment, sole 1405 may include both cavities and protruding portions to receive and engage curved plate 1420.

In one embodiment, lower surface 1412 of sole 1405 may include first cavity 1491. First cavity 1491 may be disposed adjacent to arch portion 1408 and heel portion 1404 of sole 1405. Although lower surface 1412 may comprise a generally concave contour at arch portion 1408 and heel portion 1404, first cavity 1491 may be further recessed with respect to lower surface 1412. In some embodiments, first cavity 1491 may have a shape that generally corresponds to central portion 1440 and plurality of leg portions 1450. This can allow first cavity 1491 to receive curved plate 1420 so that central portion 1440 and plurality of leg portions 1450 may be substantially flush with lower surface 1412. In other embodiments, however, lower surface 1412 may include more than one cavity that are configured to receive portions of curved plate 1420.

Sidewall portion 1415 of midsole 1410 can also include a cavity to receive a portion of curved plate 1420. In an exemplary embodiment, sidewall portion 1415 includes second cavity 1492. Second cavity 1492 may extend around a portion of sidewall portion 1415. This can allow second cavity 1492 to receive a portion of peripheral portion 1422 of curved plate 1420. In some cases, second cavity 1492 may receive peripheral portion 1422 so that peripheral portion 1422 is substantially flush with sidewall portion 1415. Furthermore, portions of peripheral portion 1422 may also be received by lower surface 1412. For example, third cavity 1493 and fourth cavity 1494, disposed on lower surface 1412, may receive end portions of peripheral portion 1422.

In order to engage curved plate 1420, lower surface 1412 may also include plurality of protruding portions 1495. In some embodiments, plurality of protruding portions 1495 may be disposed adjacent to heel portion 1404 and arch portion 1408. In one embodiment, plurality of protruding portions 1495 may be configured to engage plurality of gaps 1441. In other words, as central portion 1440 confronts lower surface 1412, plurality of protruding portions 1495 may fit within plurality of gaps 1441.

As previously discussed, sole 1405 may include plurality of tread members 1480 that can raise heel portion 1404 of sole 1405 slightly above a ground surface. In some embodiments, plurality of tread members 1480 may be disposed on peripheral sole portion 1499. This configuration may not only raise heel portion 1404 above a ground surface, but also provide traction for sole 1405. It is noted that the tread members 1480 may be spaced from one another. The curved plate 1420 may designed to be positioned between the tread members 1480 and open to the ground in the area between the tread members. The tread members 1480 may be designed to not overlap the edges of the curved plate 1420.

In one embodiment, plurality of tread members 1480 includes first tread member 1481 and second tread member 1482. First tread member 1481 and second tread member 1482 may be disposed on medial portion 1406 and lateral portion 1407, respectively, of sole 1405. In some cases, first tread member 1481 and second tread member 1482 may be separated by tread member gap 1483. Furthermore, first tread member 1481 and second tread member 1482 may be configured with cavities to engage portions of curved plate 1420. For example, first tread member 1481 and second tread member 1482 may have cavities that can receive projecting portions 1430 of curved plate 1420.

As sole 1405 receives curved plate 1420, plurality of tread members 1480 may fit within gaps in curved plate 1420. In one embodiment, first tread member 1481 may fit within medial gap 1446 of curved plate 1420. Similarly, second tread member 1482 may fit within lateral gap 1447 of curved plate 1420. In addition, second leg portion 1452 may fit within tread member gap 1483. With plurality of tread members 1480 inserted through gaps in curved plate 1420, plurality of tread members 1480 may suspend central portion 1440 of curved plate 1420 above a ground surface when sole 1405 contacts a ground surface. Using this configuration, heel cushioning system 1500 may be assembled and provide support and resiliency to heel portion 1404 of sole 1405.

With heel cushioning system 1500 assembled, outsole 1413 may be applied adjacent to curved plate 1420. In order to increase the traction capabilities of sole 1405, outsole 1413 may cover portions of midsole 1410 and curved plate 1420. For example, outsole 1413 may cover portions of forefoot portion 1403 of sole 1405 and plurality of tread members 1480. Furthermore, medial outsole portion 1416 and lateral outsole portion 1417 of outsole 1413 may cover portions of peripheral portion 1422.

Figure 16:
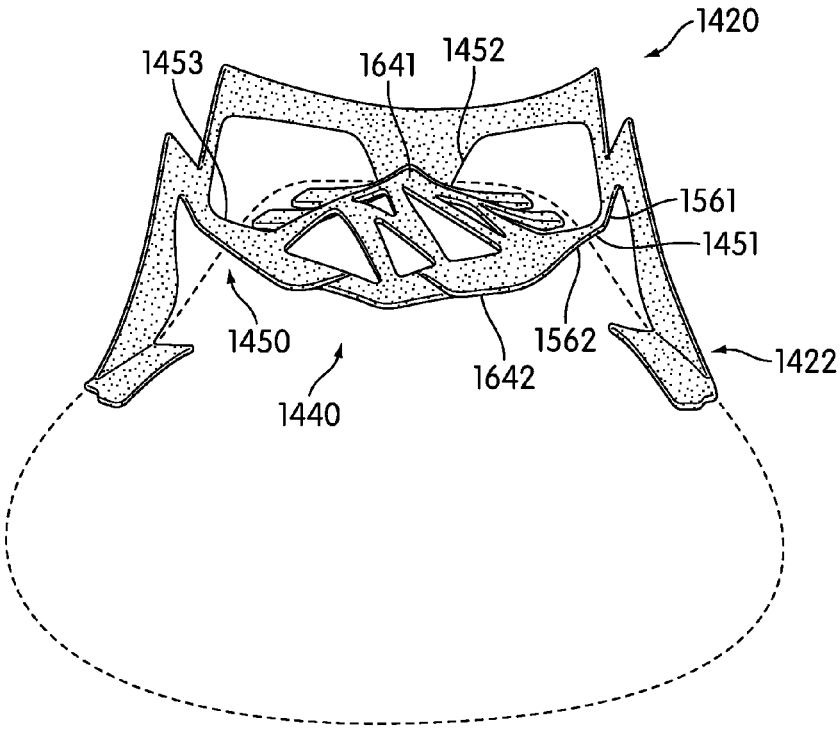
FIG. 16 is a front isometric view of an exemplary embodiment of a curved plate of a heel cushioning system in a non-deflected state.

Referring to FIGS. 15 and 16, plurality of leg portions 1450 extend outward from central portion 1440. In some cases, a first end portion and a second end portion of a leg portion may be in a substantially similar vertical plane. For example, first end portion 1561 of first leg portion 1451, disposed adjacent to peripheral portion 1422, may have a substantially similar vertical height as second end portion 1562 of first leg portion 1451, disposed adjacent to central portion 1440. In some embodiments, second leg portion 1452 and third leg portion 1453 may be configured in a similar manner with first end portions and second end portions at substantially similar vertical heights.

Although plurality of leg portions 1450 do not extend upward as plurality of leg portions 1450 join central portion 1440, plurality of leg portions 1450 continue to anchor central portion 1440 so that central portion is not free floating. This can facilitate the deflection of central portion 1440 when a force is applied to an upper surface of sole 1405, not shown for purposes of clarity. In some cases, plurality of leg portions 1450 may flex downward to facilitate the deflection of central portion 1440.

Referring to FIG. 16, central portion 1440 may have a substantially concave shape when curved plate 1420 is in a non-deflected state. In particular, central portion 1440 may extend upward from outer edge portion 1642 to peak 1641.

This configuration can raise peak 1641 above a ground surface when sole 1405, as illustrated in FIG. 14, is disposed on the ground surface.

Generally, peak 1641 may be raised from an outer sole surface various distances in a range between 0.10 inch and 2 inches. In one embodiment, peak 1641 may be raised from an outer sole surface by approximately 1 inch in a non-deflected state. With this configuration, central portion 1440 of curved plate 1420 may facilitate cushioning in the heel of an article.

Figure 17:
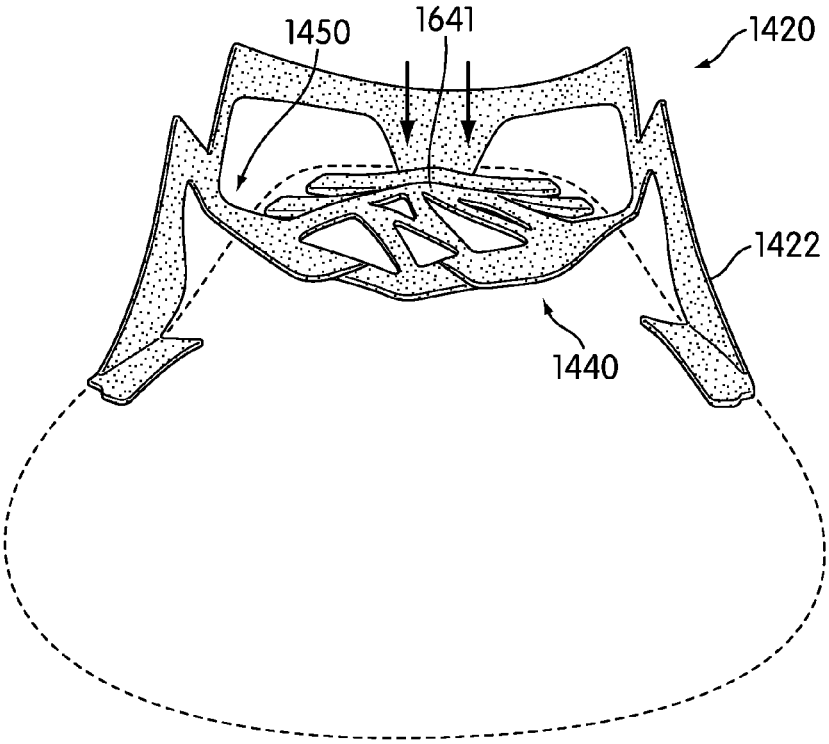
FIG. 17 is a front isometric view of an exemplary embodiment of a curved plate of a heel cushioning system in a deflected state.

FIG. 17 illustrates a front isometric view of an exemplary embodiment of curved plate 1420 when a downward force is applied to an upper surface of sole 1405. For purposes of clarity, sole 1405 and article 1400 are not illustrated in FIG. 17. However, it should be understood that central portion 1440 of curved plate 1420 may be suspended over a ground surface by a plurality of tread members 1480, as discussed with respect to FIG. 14.

As a downward force is applied, curved plate 1420 may deflect to absorb some of the force applied to an upper surface of a sole. In particular, central portion 1440 may behave in a spring-like manner and flex downward in a deflected state. In the deflected state, peak 1641 may be compressed and flatten. In some cases, plurality of leg portions 1450 may also deflect in a substantially vertical direction as a downward force is applied. In other words, plurality of leg portions 1450 may act as compression springs that allow downward vertical deflection of central portion 1440. This configuration of plurality of leg portions 1450 may also provide a restoring force in an upward vertical direction when a downward force is removed. With this configuration, curved plate 1420 of heel cushioning system 1500 can provide support and resiliency to heel portion 1404 of sole 1405, as illustrated in FIG. 14.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole including a forefoot portion, an arch portion and a heel portion;

the heel portion including a lower concave surface;

a curved plate configured for deflection when a force is applied to an upper surface of the sole;

the curved plate including:

a central portion that confronts the lower concave surface of the sole, the central portion having an approximately diamond-like shape;

a peripheral portion partially surrounding the central portion, the peripheral portion forming a continuous ring along a periphery of the heel portion of the sole;

at least one leg portion, the at least one leg portion extending from the central portion to the peripheral portion; and wherein the central portion is configured to deform under a predetermined force applied by a heel.

2. The article of footwear according to claim 1, wherein the lower concave surface of the sole includes at least one cavity configured to receive the central portion of the curved plate.

3. The article of footwear according to claim 2, wherein the at least one cavity has a shape that corresponds to the approximately diamond-like shape of the central portion.

4. The article of footwear according to claim 1, wherein the curved plate includes a first leg portion, a second leg portion and a third leg portion associated with a medial portion of the sole, a lateral portion of the sole, and the heel portion of the sole.

5. The article of footwear according to claim 4, wherein the second leg portion is associated with the heel portion of the sole; and wherein the second leg portion includes a plurality of projecting portions extending outwards from the second leg portion in a lateral direction.

6. The article of footwear according to claim 4, wherein the continuous ring formed by the peripheral portion is connected to each of the first leg portion, the second leg portion, and the third leg portion.

7. An article of footwear, comprising:

a sole including a forefoot portion, an arch portion and a heel portion;

a curved plate configured for deflection when a force is applied to an upper surface of the sole, the curved plate including a central portion having an approximately diamond-like shape and a peripheral portion disposed outward from the central portion;

the curved plate further including at least one leg portion, the at least one leg portion extending away from the central portion towards the peripheral portion;

wherein the at least one leg portion includes a first end associated with the peripheral portion, a second end associated with the central portion, and an intermediate portion disposed between the first end and the second end;

a first tread member and a second tread member disposed on a peripheral sole portion of the heel portion of the sole, the first tread member and the second tread member being separated by a gap;

wherein the first end portion of the at least one leg portion is disposed adjacent to the gap at the peripheral portion of the curved plate; and wherein the intermediate portion of the at least one leg portion is disposed through the gap between the first tread member and the second tread member.

8. The article of footwear according to claim 7, wherein the sole further includes a lower surface having a generally concave contour at the arch portion of the sole;

wherein the lower surface includes a first cavity disposed adjacent to the arch portion, the first cavity recessed with respect to the lower surface; and wherein the first cavity is configured to receive the central portion of the curved plate.

9. The article of footwear according to claim 7, wherein the at least one leg portion includes a first leg portion associated with a medial portion or a lateral portion of the peripheral portion of the sole;

wherein the curved plated further includes a second leg portion associated with the heel portion of the peripheral portion of the sole; and wherein the second leg portion includes a plurality of projecting portions extending outwards from the second leg portion in a lateral direction towards at least one of the medial portion and the lateral portion of the sole.

10. The article of footwear according to claim 9, wherein at least one of the first tread member and the second tread member include cavities configured to receive the plurality of projecting portions.

11. The article of footwear according to claim 7, wherein the curved plate extends through the heel portion of the sole and a portion of the arch portion of the sole.

12. The article of footwear according to claim 7, wherein the intermediate portion of the at least one leg portion is configured to move between the first tread member and the second tread member when the sole is compressed.

13. The article of footwear according to claim 7, wherein the peripheral portion extends in a continuous ring along the peripheral sole portion of the sole around the central portion.

14. An article of footwear, comprising:

a sole including a forefoot portion, an arch portion and a heel portion;

the sole including a longitudinal direction associated with a length of the sole;

the sole including a lateral direction associated with a width of the sole, the lateral direction being generally perpendicular to the longitudinal direction;

the sole including a vertical direction that is generally perpendicular to the longitudinal direction and the lateral direction;

the sole further comprising a curved plate disposed at the heel portion of the sole, the curved plate including a central portion and at least one leg portion extending outwards from the central portion;

the at least one leg portion including a first end portion disposed adjacent to a peripheral sole portion of the sole at the heel portion and a second end portion disposed adjacent to the central portion;

wherein the distance between the first end portion and the second end portion along the vertical direction is substantially reduced when a predetermined force is applied to the central portion of the curved plate;

wherein the at least one leg portion further includes at least one projecting portion extending outwards from the at least one leg portion in the lateral direction;

wherein the curved plate includes a peripheral portion that is disposed outwards from the central portion, the peripheral portion forming a continuous ring partially surrounding the central portion along a periphery of at least a portion the sole; and wherein the at least one leg portion connects the peripheral portion to the central portion.

15. The article of footwear according to claim 14, wherein the central portion of the curved plate includes a peak that is raised above an outer surface of the sole in a non-deflected state.

16. The article of footwear according to claim 14, wherein the at least one leg portion includes a plurality of projecting portions extending outwards from the at least one leg portion in the lateral direction.

17. The article of footwear according to claim 16, wherein the plurality of projecting portions includes at least four projecting portions.

18. The article of footwear according to claim 16, wherein the plurality of projecting portions are configured to provide strength to the curved plate.

19. The article of footwear according to claim 14, wherein the central portion includes a plurality of gaps.

20. The article of footwear according to claim 19, wherein the plurality of gaps in the central portion are triangular-shaped.

* * * * *